US005728009A

United States Patent [19]

Shanahan

[11] Patent Number: 5,728,009

[45] Date of Patent: Mar. 17, 1998

[54] GOLF PUTTER

[76] Inventor: Peter Shanahan, 13 Alvie Road, Mt Waverley Vic, Australia, 3149

[21] Appl. No.: 775,622

[22] Filed: Jan. 2, 1997

[30] Foreign Application Priority Data

Aug. 28, 1996 [AU] Australia ..... PO1923

[51] Int. Cl.[6] ..... A63B 53/02; A63B 53/04

[52] U.S. Cl. ..... 473/313; 473/314; 473/340

[58] Field of Search ..... 473/313, 314, 473/324, 340, 341, 251, 256, 243, 244

[56] References Cited

U.S. PATENT DOCUMENTS

| | | | |
|---|---|---|---|
| D. 137,863 | 5/1944 | Jakosky | 273/80 C |
| 1,334,189 | 3/1920 | Swanson | 473/325 |
| 1,631,504 | 6/1927 | Redman | 473/313 |
| 3,549,300 | 12/1970 | Pelz | 473/313 |
| 3,625,517 | 12/1971 | Durnack | 473/313 |
| 5,454,564 | 10/1995 | Kronogard | 473/313 |

FOREIGN PATENT DOCUMENTS

| | | | |
|---|---|---|---|
| 2081590 | 2/1982 | United Kingdom | 273/80 C |

*Primary Examiner*—Sebastiano Passaniti

*Attorney, Agent, or Firm*—McCormick, Paulding & Huber

[57] ABSTRACT

The golf putter comprises a head having an anterior putting face and a shaft secured to the head at the connection point. The connection point where the shaft is secured to the head is located distal to the midline extending through the putting face forwardly in an anterior direction along which the golf ball is propelled after being struck so that the shaft as it extends upwardly is directed from the distal side of the midline towards the proximal side thereof. The shaft in front view crosses a vertical plumb line intersecting the midline. The connection point is provided in a posterior section of the head displaced in the posterior direction from the anterior putting face. The shaft as it extends upwardly is inclined from the connection point towards the anterior direction. The center of gravity of the head is located forwardly in the anterior direction from the connection point and is located towards the proximal side of the head from connection point.

9 Claims, 2 Drawing Sheets

GOLF PUTTER

FIELD OF THE INVENTION

This invention relates to golf putters.

BACKGROUND OF THE INVENTION

A golf putter consists of a head having an anterior putting face for striking a golf ball and a shaft secured to the head at a connection point, the shaft extending upwardly for being gripped by a golfer. Golf putters generally are one of two types—"mallet" headed putters in which the head is a solid, hollow or shaped mass with the flat anterior putting face, and a "blade" type of putter with a plate-like head having a flat anterior putting face. Some known putters have the shaft connected to the head at a point located to the proximal side of the midline of the head (relative to the golfer), i.e. at the heel of the putting face or spaced in the posterior direction relative to the heel of the putting face. Other known putters are "centre shafted", i.e. the shaft is connected to the head at a connection point which is located substantially on the midline extending through the putting face. The putters which have the shaft located on the proximal side of the midline have the centre of gravity of the head displaced in a distal direction from the connection point of the shaft so that the putter has a similar weight distribution and therefore a similar "feel" to other golf clubs, namely irons and drivers. Centre shafted putters have a slightly different feel to other golf clubs since the centre of mass of the putter head is on the midline and the connection point of the shaft is also on the midline.

However, both centre shafted putters and putters with a shaft connection point to the proximal side of the midline are of sufficiently similar balance or feel to other golf clubs (irons and drivers) that the movement of the club head by the golfer can naturally follow the initial path of movement of a conventional golf club swing. However, it is generally considered undesirable to draw a putter head back inside a straight line where the head of a normal golf club is drawn when it is being swung. On the contrary, it is generally recommended to golfers that they draw the putter head back in a straight line and then move the putter head forwardly along the same line to strike the ball. Sometimes the desired movement is compared to the movement of a pendulum which the golfer must try to emulate. The straight linear or pendulum movement has long been known as a desirable putting action. To achieve this, variations in stance of the golfer and handgrip on the shaft are commonly used techniques to try to achieve the desired pendulum movement.

Another attempt to achieve the straight linear or pendulum movement has been to provide a golf putter with a very long shaft, of sufficient length to reach the chin of the golfer. This kind of putter in use has its upper end contacting the point of the chin of the golfer so that the golfer attempts to move the putter with a pendulum movement with the upper end of the shaft touching the golfer's chin providing the pivot point for the pendulum movement.

SUMMARY OF THE INVENTION

It is an object of the present invention to provide a golf putter which can help a golfer to achieve a pendulum movement, i.e. drawing the head away from the ball in a straight line without drawing the head inside of that line, and returning the head to the impact point along the same line.

The golf putter according to the present invention comprises:

a head having an anterior putting face for striking a golf ball, and a connection point provided by the head, a shaft secured to the head at the connection point and extending upwardly for being gripped by a golfer, wherein the head has a midline extending through the putting face forwardly in an anterior direction along which the golf ball is propelled after being struck and extending in a posterior direction through the head, and wherein the connection point where the shaft is secured to the head is located distal to the midline relative to the golfer so that the shaft as it extends upwardly is directed from the distal side of the midline towards the proximal side thereof.

It has been surprisingly found that by locating the connection point to the distal side of the midline and arranging the shaft so that it is directed from the distal side of the midline back towards the proximal side, i.e. towards the golfer in use, the appearance and feel of the putter is substantially different to other golf clubs (irons and drivers) and there is less inclination or propensity of the golfer to draw the head back inside the desired straight line as is done when swinging other golf clubs. This surprising and unexpected result is possibly due to the different weight distribution and "feel" of the club avoiding the conditioned muscles of the golfer from repeating the practised and conditioned swinging movement that the golfer uses for other clubs.

Preferably the anterior putting face has a bottom edge located and arranged so that when the bottom edge is located on or parallel to horizontal ground, the shaft in front view crosses a vertical plumb line intersecting the midline as it extends upwardly from the connection point distal to the midline. The shaft has an upper end and, as the shaft extends upwardly it preferably crosses the midline so that the upper end is approximately above or is located inside of the proximal side of the head in plan view. The head may have a posterior section, the connection point being provided in the posterior section displaced in the posterior direction from the anterior putting face. In this arrangement, the shaft as it extends upwardly is preferably directed from the connection point displaced in the posterior direction from the anterior putting face towards the anterior direction.

The preferred golf putter has the centre of gravity of its head located substantially on the midline so that it is located forwardly in the anterior direction from the connection point and is located towards the proximal side of the head from connection point.

The head may have a raised section which is located on the distal side of the midline and which is located in the posterior direction relative to the anterior putting face, the connection point being located in the raised section of the head. In this embodiment, the head may have a base located beneath the head, the base having a profile which when viewed from a point laterally spaced from the midline extends upwardly towards the raised section of the head. The profile of the base is preferably substantially horizontal in the vicinity of the anterior putting face and which then extends upwardly towards the raised section of the head.

BRIEF DESCRIPTION OF THE DRAWINGS

Possible and preferred features of the present invention will now be described with particular reference to the accompanying drawings. However it is to be understood that the features illustrated in and described with reference to the drawings are not to be construed as limiting on the scope of the invention. In the drawings.

DESCRIPTION OF PREFERRED EMBODIMENT

Figure 1:
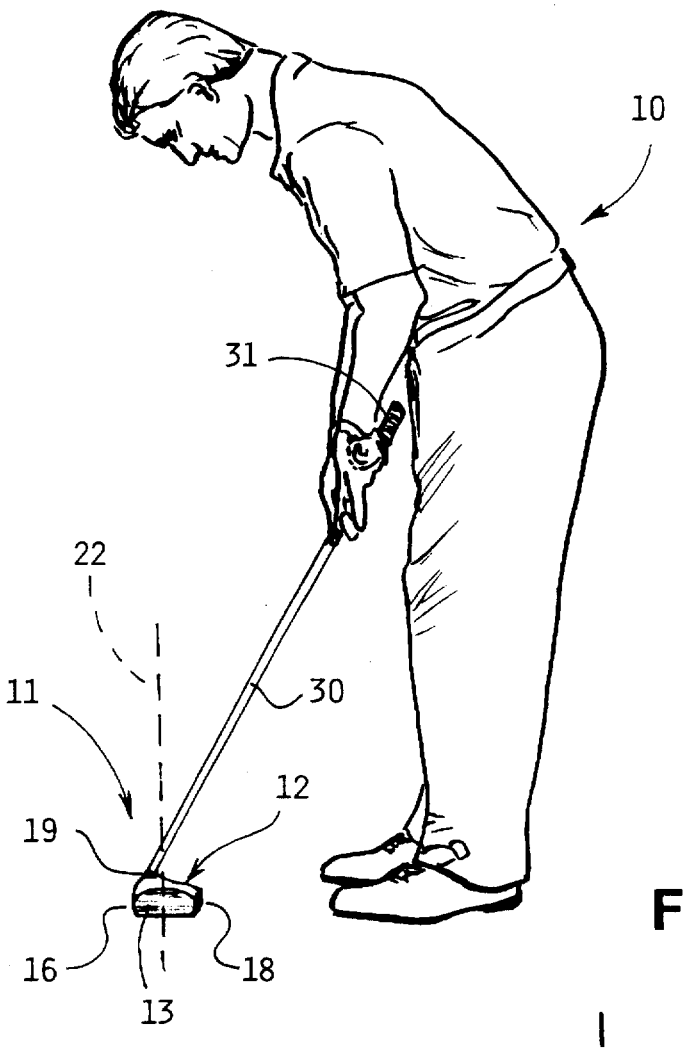
FIG. 1 is a front view of a golfer using a golf putter according to the present invention.

The golfer and putter shown in the drawings are right handed, i.e. the golfer 10 takes the putter away from the viewer and then returns the putter striking the golf ball directly towards the viewer. A left handed golfer would use a golf putter which is a mirror image of the illustrated putter.

The golf putter 11 has a head 12 and a shaft 30. The head 12 has an anterior putting face 13 for striking a golf ball, the anterior face 13 being flat and having a substantially straight bottom edge 14 which is rested on or held slightly elevated above and parallel to horizontal ground. The superior surface of the head, including the superior boundary 15 of the putting face 13, is curved so as to extend upwardly at the distal side or toe 16 of the face 13, across the top 17, and down at the proximal side or heel 18. This particular profile of the superior surface of the head, however, is not essential.

Figure 5:
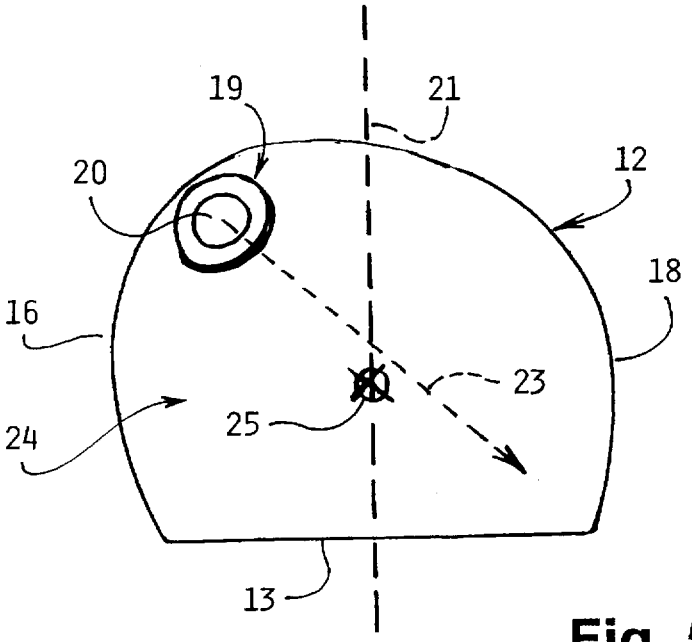
FIG. 5 is a superior or plan view of the head.
Figure 2:
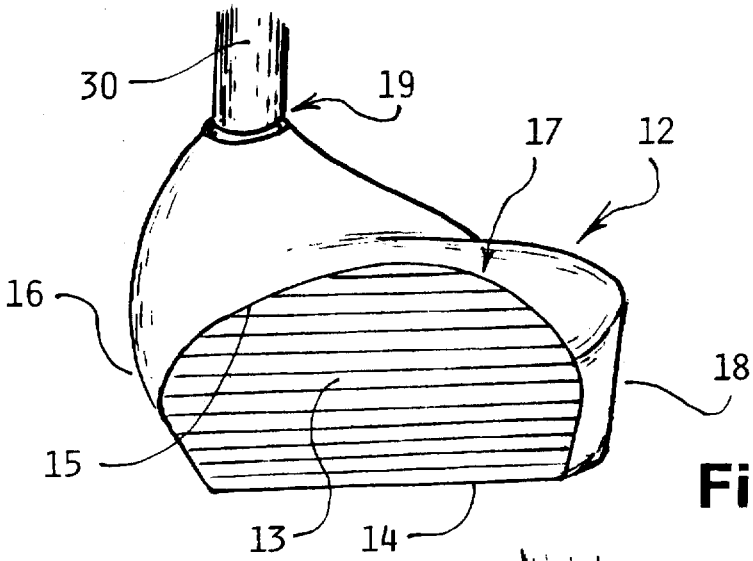
FIG. 2 is an anterior or front view of a head and shaft connection of a putter according to the present invention.

The head 12 has a connection point 19, such as an indented or recessed area 20 where the shaft 30 is connected. For convenience of describing the features and configuration of the putter, I define the head 12 as having a midline 21 (FIG. 5) extending through the putting face 13 forwardly in an anterior direction along which the golf ball is propelled after being struck and extending in a posterior direction through the head 12. The connection point 19 where the shaft 30 is secured to the head is located distal to the midline 21 so that as seen in FIG. 1 the shaft 30 as it extends upwardly is directed from the distal side 16 of the midline 21 towards the proximal side 18. The recess 20 can extend into the head at an angle so that when the bottom end of the shaft 30 is inserted, the shaft extends at the desired inclination relative to the head. As seen in FIG. 1, when the bottom edge 14 is located on or parallel to horizontal ground, the shaft 30 in front view crosses a vertical plumb line 22 which intersects the midline, 21 as the shaft extends upwardly from the connection point 19 distal to the midline. Also as seen in FIG. 1, the upper end 31 of the shaft crosses the midline 21 so that the upper end 31 is approximately above or, more preferably as illustrated, is located inside of the proximal side 18 of the head.

In the superior aspect or plan view of the head (FIG. 5), it will be seen that the head is curved throughout the posterior section 24 extending rearwardly from the anterior putting face 13. However, other profiles in plan view are possible. The connection point 19 is provided in the posterior section 24 so as to be displaced in the posterior direction from the putting face 13. In this arrangement, the shaft 30 as it extends upwardly is directed from or is inclined from the connection point 19 towards the anterior direction, i.e. towards the anterior putting face 13, as shown by the broken line 23 in FIG. 5. That is, the shaft 30 as it extends upwardly from the connection point 19 is inclined relative to the horizontal ground from the distal side 16 of the head 12 towards the proximal side 18 of the head and simultaneously from the posterior section 24 of the head towards the anterior putting face 13.

The head preferably has a centre of gravity 25 which is located substantially on the midline 21 in plan view (FIG. 5) so that it is located forwardly, i.e. in the anterior direction, from the connection point 19 and is located towards the proximal side 18 of the head 12 from the connection point 19.

Figure 3:
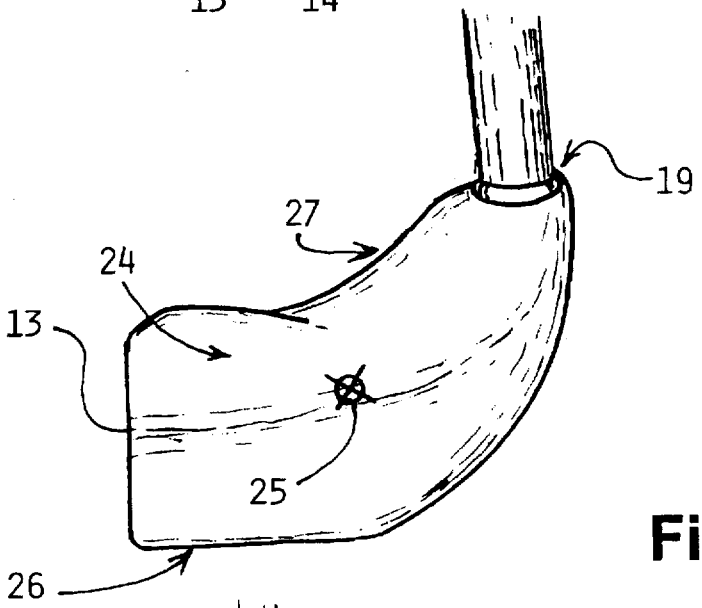
FIG. 3 is a proximal aspect or inside elevational view of the head and shaft connection.
Figure 4:
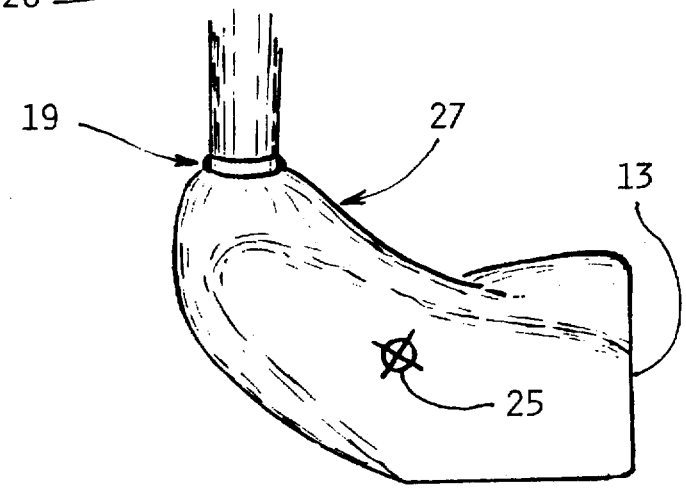
FIG. 4 is a distal aspect or outside elevation of the head and shaft connection.

As best seen in FIGS. 3 and 4, the head 12 has a base 26 located beneath the head which extends in the posterior direction from the bottom edge 14 of the anterior putter face 13. The head 12 has a raised section 27 which is located on the distal side of the midline 21 and which is located in the posterior direction relative to the anterior putting face 13. The connection point 19 is located in the raised section 27 of the head. The base 26 is flat adjacent to and immediately in the posterior direction from the bottom edge 14 and has a profile which, when viewed from a point laterally spaced from the midline (as shown in FIGS. 3 and 4), curves upwardly towards the raised section 27.

In summary, the shaft 30 is elongated and has a longitudinal axis which extends along the line 23. Thus the lower end of the shaft 30 is connected to the putter head in the raised section 27 posterior to the distal side or toe 16 of the head 12 and also distal to the midline 21 which extends along a longitudinal upright plane through the club head 12.

In use, the golf putter is held by the golfer 10 as shown in FIG. 1 so that the head 12 is located substantially to the proximal side of the connection point 19. The centre of gravity 25 is located a distance to the proximal side of the connection point 19 and preferably also a distance in the anterior direction from the connection point 19. This configuration of head and shaft, including the location of the centre of gravity 25 relative to the connection point 19 creates a substantially different appearance and feel to the golfer to other golf clubs. This different configuration and feel surprisingly induces the golfer when taking the club head back from the golf ball to be struck to resist the inclination or propensity to draw the club head inside the desired straight line. None of the prior known putter designs have suggested, and no designs of other golf clubs have suggested, such a significant shifting of weight distribution and feel of the club head so that the putter has a distinctly different, even "strange", feel to the golfer. The different feel can either encourage the desirable straight linear or pendulum movement or can at least discourage the trained or conditioned movement or swing of the golfer used for other clubs in which the club is drawn inside the desired straight line.

It is to be understood that various alterations, modifications and/or additions may be made to the features of the possible and preferred embodiment(s) of the invention as herein described without departing from the scope of the invention as defined in the claims.

What I claim is:

1. A golf putter comprising:

a head having an anterior putting face for striking a golf ball, and a connection point provided by the head, and a shaft secured to the head at the connection point and extending upwardly for being gripped by a golfer, wherein the head has a midline extending through the putting face forwardly in an anterior direction along which the golf ball is propelled after being struck and extending in a posterior direction through the head, wherein the connection point where the shaft is secured to the head is located distal to the midline relative to the golfer so that the shaft as it extends upwardly is directed from the distal side of the midline towards the proximal side thereof, and wherein the head has a center of gravity which is located substantially on the midline so that it is located forwardly in the anterior direction from the connection point and is located towards the proximal side of the head from the connection point.

2. A golf putter as claimed in claim 1 wherein the anterior putting face has a bottom edge located and arranged so that when the bottom edge is located on or parallel to horizontal ground, the shaft in front view crosses a vertical plumb line intersecting the midline as it extends upwardly from the connection point distal to the midline.

3. A golf putter as claimed in claim 2 wherein the shaft has an upper end and, as the shaft extends upwardly, it crosses the midline so that the upper end is approximately above or is located inside of the proximal side of the head in plan view.

4. A golf putter as claimed in claim 3 wherein the head has a posterior section, the connection point being provided in the posterior section displaced in the posterior direction from the anterior putting face.

5. A golf putter as claimed in claim 4 wherein the shaft as it extends upwardly is directed from the connection point displaced in the posterior direction from the anterior putting face towards the anterior direction.

6. A golf putter comprising:

a head having an anterior putting face for striking a golf ball, and a connection point provided by the head, and a shaft secured to the head at the connection point and extending upwardly for being gripped by a golfer, wherein the head has a midline extending through the putting face forwardly in an anterior direction along which the golf ball is propelled after struck and extending in a posterior direction through the head, wherein the connection point where the shaft is secured to the head is located distal to the midline relative to the golfer so that the shaft as it extends upwardly is directed from the distal side of the midline towards the proximal side thereof, wherein the anterior putting face has a bottom edge located and arranged so that when the bottom edge is located on or parallel to horizontal ground, the shaft in front view crosses a vertical plumb line intersecting the midline as it extends upwardly from the connection point distal to the midline, and wherein the head has a raised section which is located on the distal side of the midline and which is located in the posterior direction relative to the anterior putting face, the connection point being located in the raised section of the head.

7. A golf putter as claimed in claim 6 wherein the head has a base located beneath the head, the base having a profile which when viewed from a point laterally spaced from the midline extends upwardly towards the raised section of the head.

8. A golf putter as claimed in claim 7 wherein the profile of the base is substantially horizontal in the vicinity of the anterior putting face and which then extends upwardly towards the raised section of the head.

9. A golf putter as claimed in claim 6 wherein the head has a centre of gravity which is located substantially on the midline so that it is located forwardly in the anterior direction from the connection point and is located towards the proximal side of the head from connection point.

* * * * *